United States Patent [19]

Reiter

[11] Patent Number: 4,660,011

[45] Date of Patent: Apr. 21, 1987

[54] POLARIZED ELECTROMAGNET FOR A FUEL INJECTION VALVE

[75] Inventor: Ferdinand Reiter, Markgrönningen, Fed. Rep. of Germany

[73] Assignee: Robert Bosch GmbH, Stuttgart, Fed. Rep. of Germany

[21] Appl. No.: 860,936

[22] Filed: May 8, 1986

[30] Foreign Application Priority Data

Jun. 5, 1985 [DE] Fed. Rep. of Germany ..... 3520142

[51] Int. Cl.[4] ..... H01F 7/08

[52] U.S. Cl. ..... 335/230; 335/279; 251/129.01

[58] Field of Search ..... 335/229, 230, 234, 279, 335/281; 251/129.01

[56] References Cited

U.S. PATENT DOCUMENTS

| | | | |
|---|---|---|---|
| 2,708,245 | 5/1955 | Werner | 335/230 X |
| 3,091,725 | 5/1963 | Huston | 335/230 |
| 4,419,643 | 12/1983 | Ojiua et al. | 335/234 |
| 4,546,339 | 10/1985 | Kubach | 335/230 |

*Primary Examiner*—George Harris
*Attorney, Agent, or Firm*—Edwin E. Greigg

[57] ABSTRACT

An electromagnet which serves particularly to control a fuel injection valve for fuel injection systems in internal combustion engines. The electromagnet includes an inner core of soft-magnetic material, which is surrounded by a magnetic coil. An outer core at least partly surrounds the magnetic coil and has an outer pole located in the same plane as an inner pole of the inner core. On one side of the magnetic coil, between the inner core and the outer core, there is a first annularly embodied and radially magnetized permanent magnet, and on the other side of the magnetic coil there is a second annularly embodied and radially magnetized permanent magnet. Facing the poles, there is an armature, which at one end is joined to a valve needle that has a valve body cooperating with a valve seat, and on its other end forms a first working air gap with the outer pole and a second working air gap with the inner pole. The permanent magnets are poled such that their magnetic fields at the working air gaps extend counter to the electromagnetic field induced by the magnetic coil.

17 Claims, 4 Drawing Figures

POLARIZED ELECTROMAGNET FOR A FUEL INJECTION VALVE

BACKGROUND OF THE INVENTION

The invention is based on an electromagnet of the type defined hereinafter. An electromagnet of an electromagnetically actuatable valve having a built-in permanent magnet has already been proposed, in which in the non-excited state the armature is attracted to the core, while upon electromagnetic excitation the armature assumes a position spaced apart from the core. This kind of valve has the advantage of not requiring any holding current in the position of repose. However, because cylindrical and flat magnets are used, the valve is large in terms of its structural size.

OBJECT AND SUMMARY OF THE INVENTION

The electromagnet according to the invention has the advantage over the prior art of a compact structure, because of the use of at least one annular, radially magnetized permanent magnet and because of the resultant shape of the core. The use of two permanent magnets is another advantageous feature. This means that a greater holding force is attained when there is no electric current flowing through the coil, and as a result the electromagnet can also be used in a fuel injection valve in which relatively high fuel injection pressures prevail, without running the risk that the pressure of the fuel will separate the armature from the pole shoes.

It is advantageous for both permanent magnets to be annular in shape and radially magnetized.

It is also advantageous to provide an opening in the valve housing or in the outer core, through which it is possible to exert specifically intended influence upon the permanent magnet by means of a magnetic field imposed from outside. This enables an adjustment of the dynamic injection quantity of the valve.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
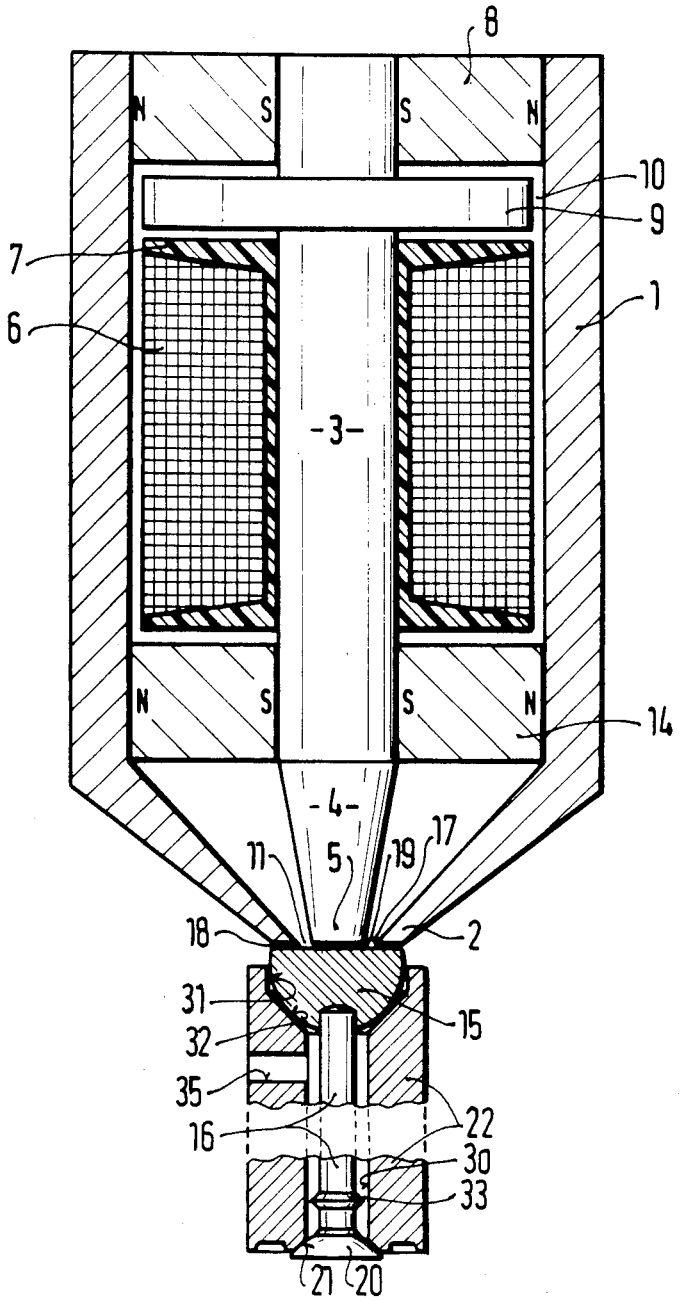
FIG. 1 shows in cross section a first exemplary embodiment of an electromagnet according to the invention.

In the electromagnet shown in FIG. 1 for a fuel injection valve of a fuel injection system for internal combustion engines, there is an outer core 1 which is cup-shaped, for example, with a tapering bottom in the form of a truncated cone. The frustoconical end of the outer core 1 is flattened in a plane that is at right angles to the axis of the valve, thereby leaving an opening 11 free along the axis. The outlet end of the truncated cone of the outer core 1 forms an annular outer pole 2, assuming that the outer core is embodied as a closed ring. An axially aligned inner core 3 is located coaxially inside the outer core 1 that surrounds it; the inner core 3 may be of the same length as the outer core. For the length along which the outer core 1 is cylindrical, the inner core 3 takes the form of a solid cylinder. In the vicinity of the truncated cone of the outer core 1, the inner core 3 tapers as well to form a conical section 4, which ends in an inner pole 5, which is located in the same plane as the outer pole 2 and surrounded by the outer pole 2 and thus points toward the opening 11.

Between the inner core 3 and the outer core 1, resting on the inner core, is a magnetic coil 6 which is wound on a coil holder 7. Electric current leads, not shown, serve to supply current to the magnetic coil.

On the side of the magnetic coil 6 remote from the poles 2, 5, there is a magnetically conductive ring 9 extending radially with respect to the outer core 1. This ring 9 is either firmly joined to the inner core 3 or is a part thereof, and its outer diameter is such that there is an annular gap 10 between the ring 9 and the outer core 1. On the side of the ring 9 remote from the poles 2, 5, there is an annular first permanent magnet 8, which is positioned within the space between the inner core 3 and the outer core 1 and flush with them. This permanent magnet 8 is radially poled; that is, it has either a south pole on the inner jacket and a north pole on the outer jacket as shown by way of example in the drawing or a north pole on the inner jacket and a south pole on the outer jacket. On the other side of the magnetic coil 6, again positioned within the space between the inner core 3 and the outer core 1, is an annular second permanent magnet 14, having its poles arranged identically to those of the first permanent magnet 8.

An armature 15 is disposed facing the end faces of the outer pole 2 and the inner pole 5, being embodied approximately as a hemisphere having its flat side 17 facing the two poles 2, 5. A first working air gap 18 is formed between the flat side 17 of the armature 15 and the outer pole 2 of the outer core 1, and a second working air gap 19 is formed between the armature 15 and the inner pole 5 of the inner core 3. Various other shapes of the armatures and poles are also conceivable here, however. For instance, the plane that includes the working air gaps of the outer pole 2 and armature 15, on the one hand, and of the inner pole 5 and armature 15, on the other, may be concave or convex, with a circular or elliptical curvature. A bore is machined into the round side of the armature 15, and a valve needle 16 is secured in this bore, for instance by welding or soldering. The valve needle 16 is cylindrical and on its other end is firmly joined to a valve body 20, which in cooperation with a valve seat 21 opens or closes the valve. The valve body 20 and valve seat 21 are arranged such that when the valve body 20 moves toward the poles 2, 5, the valve body 20 rests on the valve seat 21 and closes the valve. The valve seat 21 is machined into the end face of a cylindrical valve seat body 22. The valve seat body 22 and the outer core 1 are joined to one another in such a way that relative movement between them is impossible; this can be done for instance by securing them in the same valve housing not shown in the drawing.

The valve seat 21 is adjoined by a coaxial bore 30 which penetrates the valve seat hody 22. On the side of the valve seat body 22 remote from the valve seat 21 and facing the poles 2, 5, there is a further bore 31 which includes an annular wall that is parallel with the bore 30 but spaced outwardly thereof. Thus the diameter of the bore 31 is larger than that of the bore 30 and slightly larger than the diameter of the armature 15, which is radially guided by the bore 31. A transition zone 32 between the bore 30 and the bore 31 is conical and serves as a stop for the maximum opening stroke of the valve needle 16 and valve body 20. Near the valve body 20, on the valve needle 16, there is a collar 33 of triangular or other shape in the axial direction; its outer diameter being slightly smaller than the diameter of the bore 30 that surrounds it.

The supply of fuel to the bore 30 is effected via at least one feed opening 35 in the valve seat body 22. This opening extends radially from the jacket of the valve seat body 22 to the bore 30, in the portion of the bore 30 that is located on the side of the collar 33 nearer the armature 15.

OPERATION

The function of the electromagnetic fuel injection valve is as follows:

When the magnetic coil 6 is not provided with electric current, magnetic fields are generated only by the permanent magnets 8 and 14; the armature 15 is thus attracted by the outer pole 2 and inner pole 5, and the valve body 20 is moved sealingly onto the valve seat 21. The magnetic flux generated by the first permanent magnet 8 extends on the one hand via the outer core 1, outer pole 2, armature 15, inner pole 5 and inner core 3 back to the first permanent magnet and thereby also surrounds the magnetic coil 6. On the other hand, a portion of the magnetic flux generated by the first permanent magnet 8 extends via the outer core 1, the annular gap 10, the ring 9 and the inner core 3 back to the first permanent magnet. The magnetic flux generated by the second permanent magnet 14 travels in the same direction as that of the first permanent magnet 8, that is, via the output core 1, outer pole 2, armature 15, inner pole 5 and inner core 3 back to the second permanent magnet.

On the other hand, if the magnetic coil 6 is supplied with electrical voltage, then as a result an electromagnetic field is induced such that the field lines of the electromagnetic field in the first working air gap 18 and in the second working air gap 19 extend in the opposite direction from the field lines of the magnetic fields generated by the permanent magnets 8, 14. The excitation of the magnetic coil 6 should be of such magnitude that the field intensity of the electromagnetic field in the vicinity of the working air gaps 18, 19 is equal to the field intensity of the magnetic field of the permanent mangets 8, 14, so that no further magnetic force is exerted upon the armature 15, and the valve can open. The magnetic flux of the electromagnetic field extends, first, via the inner core 3, inner pole 5, armature 15, outer pole 2, outer core 1, annular gap 10 and ring 9, back to the inner core 3. The ring 9 having the annular gap 10 is useful, because the first permanent magnet 8 conducts the electromagnetic flux only with difficulty. In designing the diameter of the inner core 3, care should be taken to assure that when the magnetic coil 6 has current flowing through it, a state of saturation of the induced magnetic flux occurs.

Because of the compensation of the field intensities of the magnetic fields at the armature 15 that are induced by the permanent magnets 8, 14 and by the magnetic coil, the only remaining static force exerted on the armature 15 is the hydraulic pressure of the fuel. This force can be determined from the area of the pressure-receiving faces of the armature 15 and valve body 20 and from the fuel pressure.

Figure 2:
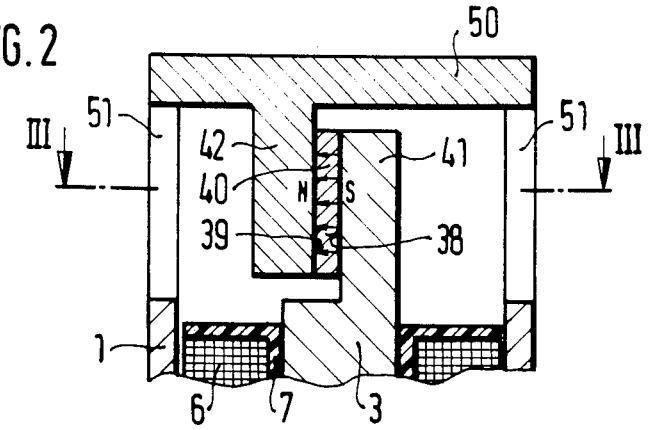
FIG. 2 is a fragmentary cross section view of another exemplary embodiment of an electromagnet according to the invention.
Figure 3:
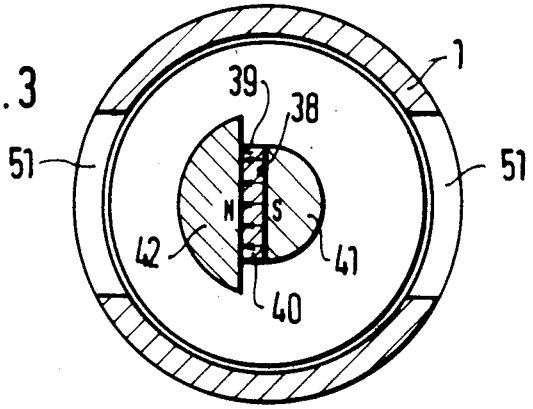
FIG. 3 is a sectional taken along the line III—III of FIG. 2.

In the exemplary embodiment shown in FIGS. 2 and 3, the elements that remain the same as and function like those of the exemplary embodiment of FIG. 1 are identified by the same reference numerals. The annular first permanent magnet 8 in FIG. 1 is replaced, in the embodiment of FIGS. 2 and 3, by a first permanent magnet in the form of a flat magnet 40, which is fixed between two magnetically conductive supports 41, 42 such that each of its poles rests on one of the supports 41, 42. The cross section of both supports 41, 42 takes the form of part of a circle; the flat magnet 40 is fastened between a flat side 38 of the support 41 and a flat side 39 of the support 42. The support 41 is embodied as an extension of the inner core 3 in the direction remote from the valve seat 21, so that the flat side 38 extends parallel to the longitudinal axis of the inner core 3. The support 42 is part of a cap 50, which is fixed on the end face of the outer core 1 remote from the valve seat 21 and extends in the direction toward the inner core 3. This cap, like the outer core 1, is of soft-magnetic material and is part of both the electromagnetic circuit and the magnetic circuit induced by the flat magnet 40. A connection that reduces the magnetic resistance inside the electromagnetic circuit, such as that furnished by the ring 9 and the annular gap 10 in the exemplary embodiment of FIG. 1, can be omitted whenever the flat magnet 40 is embodied as sufficiently narrow in the north-south direction between the flat sides 38, 39 of the supports 41, 42.

At least two openings 51 of rectangular or other shape are machined on the end of the outer core 1 remote from the valve seat 21. By means of a device, not shown, that acts from the outside, influence can be exerted upon the flat armature 40 by an external magnetic field through these openings 51. As a result, the intensity of the magnetic field which acts upon the armature, and hence the dynamic injection quantity of the injection valve, can be adjusted in a specifically intended way.

Since at the present time the radially magnetized annular permanent magnets 8, 14 can be obtained only at very great expense, it is proposed that an annular magnet be replaced by an arrangement of a plurality of separate magnets that together form an approximately circular shape.

Figure 4:
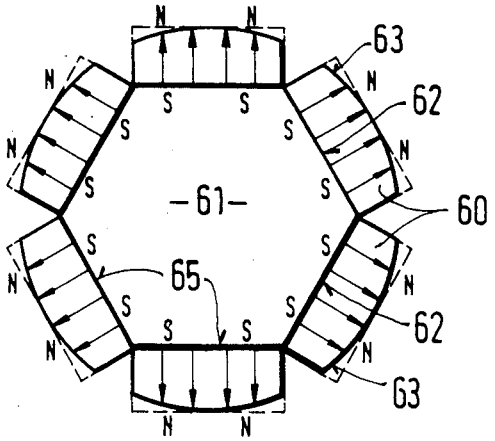
FIG. 4 shows an exemplary embodiment of an annular magnet put together from a plurality of separate magnets.

FIG. 4 shows an exemplary embodiment in which six rectangular magnets 60 are disposed on a holder body 61 of soft-magnetic material. The circumference of the holder body 61 is embodied as a regular polygon; in this example it has six contact faces 62, with one of the magnets 60 resting on each face. The poles of all the rectangular magnets 60 have the same orientation in the radial direction. By machining the holder body 61 on the inside and by machining the faces 63 of the magnets 60 remote from the holder body 61 so that they each have the shape of an arc of a circle, for instance by turning or grinding them, a transition to the form of a ring is attainable. The original shape of the magnets 60 is represented by dotted lines.

It is also possible to machine the faces 63 in the form of a ring in the above-described manner, after fastening the magnets 60 on a common workpiece holder and thereby assuring fixation of the magnets 60 in the form of a regular polygon. If the inner core 3 is embodied with the cross-sectional shape of a regular prism, the length of the sides of which is equal to the length of a pole face 65 of one of the magnets 60, and the number of sides of which is equal to the number of magnets 60, then the magnets 60 can be individually inserted between the inner core 3 and outer core 1 without having to use a holder body.

It is also possible, after fastening the magnets 60 to a common workpiece holder in the manner described above, to machine the inner pole faces 65 of the magnets 60 in the form of a ring as well. The inner core 3 is then embodied with a cylindrical cross section.

By disposing individual magnets 60 between the inner core 3 and outer core 1 in the above-described manner, a quasi-annular permanent magnet, which is magnetized in the radial direction, is obtained. The hexagonal arrangement of the rectangular magnets 60 shown and described by way of example can be adapted to any desired regular polygons.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An electromagnet for controlling a fuel injection valve for fuel injection systems in internal combustion engines, having an armature (15) an outer (1) and inner (3) core of soft-magnetic material, a magnetic coil (6) within said outer core surrounding said inner core, a first permanent magnet (8, 40) disposed on one side of said magnetic coil (6) and a second permanent magnet (14) disposed on the other side of said magnetic coil; said second permanent magnet (14) is annular in embodiment and is radially magnetized; a first working air gap (18) formed between said outer core (1) and said armature (15) and a second working air gap (19) formed between said inner core (3) and the armature; and said permanent magnets (8, 14, 40) are poled such that their magnetic fields at the working air gaps (18, 19) extend counter to the electromagnetic field induced by the magnetic coil (6).

2. An electromagnet as defined by claim 1, characterized in that the field intensities of the magnetic fields generated by the permanent magnets (8, 14, 40) and the field intensity of the electromagnetic field generated by the magnetic coil (6) compensate for one another, to yield a net field intensity of zero, in the vicinity of the first working air gap (18) and second working air gap (19).

3. An electromagnet as defined by claim 2, characterized in that said first permanent magnet (8) is annularly embodied and radially magnetized.

4. An electromagnet as defined by claim 1, characterized in that said first permanent magnet (40) is a flat magnet (40) magnetized at right angles to the longitudinal axis of the inner core (3).

5. An electromagnet as defined by claim 2, characterized in that said first permanent magnet (40) is a flat magnet (40) magnetized at right angles to the longitudinal axis of the inner core (3).

6. An electromagnet as defined by claim 4, characterized in that said first permanent magnet (50) rests with one pole on a flat side (38) of said inner core (3) extending parallel to the longitudinal axis of said inner core (3) and with its other pole on a flat side (39) of a magnetically conductive support (42), which is part of a magnetically conductive cap (50) leading to said outer core (1).

7. An electromagnet as defined by claim 5, characterized in that said first permanent magnet (50) rests with one pole on a flat side (38) of said inner core (3) extending parallel to the longitudinal axis of said inner core (3) and with its other pole on a flat side (39) of a magnetically conductive support (42), which is part of a magnetically conductive cap (50) leading to said outer core. (1).

8. An electromagnet as defined by claim 4, characterized in that said outer core (1) has two openings (51) opposite one another, via which said first permanent magnet (40) can be brought into the range of influence of a magnetic field imposed from the outside of said outer core (1).

9. An electromagnet as defined by claim 5, characterized in that said outer core (1) has two openings (51) opposite one another, via which said first permanent magnet (40) can be brought into the range of influence of a magnetic field imposed from the outside of said outer core (1).

10. An electromagnet as defined by claim 1, characterized in that said first permanent magnet (8) is embodied by a holder body (61) of soft-magnetic material, the circumference of which is embodied as a regular polygon having at least six contact faces (62), on each of which one rectangular magnet (60), magnetized in the radial direction, rests, the face (63) of which magnet (60) remote from the holder body (61) extends in the form of a circular arc.

11. An electromagnet as defined by claim 4 characterized in that said first magnet (8) is embodied by a holder body (61) of soft-magnetic material, the circumference of which is embodied as a regular polygon having at least six contact faces (62), on each of which one rectangular magnet (60), magnetized in the radial direction, the face (63) of which magnet (60) remote from the holder body (61) extends in the form of a circular arc.

12. An electromagnet as defined by claim 5 characterized in that magnet (8) is embodied by a holder body (61) of soft-magnetic material, the circumference of which is embodied as a regular polygon having at least six contact faces (62), on each of which one rectangular magnet (60), magnetized in the radial direction, rests, the face (63) of which magnet (60) remote from the holder body (61) extends in the form of a circular arc.

13. An electromagnet as defined by claim 1, characterized in that said permanent magnet (8) is replaced by a plurality of magnets (60), which are inserted in between said inner core (3) and said outer core (1) in such a manner that said plurality of magnets rest with an inner face, which is simultaneously one magnetic pole of one of the magnets (60), on the circumference of the inner core (3), and that with an outer face (63), which is simultaneously the other magnetic pole of one of the magnets (60), on the inside of the outer core (1).

14. An electromagnet as defined by claim 2, characterized in that said permanent magnet (8) is replaced by a plurality of magnets (60), which are inserted in between said inner core (3) and said outer core (1) in such a manner that said plurality of magnets rest with an inner face, which is simultaneously one magnetic pole of one of the magnets (60), on the circumference of the inner core (3), and that with an outer face (63), which is simultaneously the other magnetic pole of one of the magnets (60), on the inside of the outer core (1).

15. An electromagnet as defined by claim 3, characterized in that said permanent magnet (8) is replaced by a plurality of magnets (60), which are inserted in between said inner core (3) and said outer core (1) in such a manner that said plurality of magnets rest with an inner face, which is simulataneously one magnetic pole of one of the magnets (60), on the circumference of the inner core (3), and that with an outer face (63), which is simultaneously the other magnetic pole of one of the magnets (60), on the inside of the outer core (1).

16. An electromagnet as defined by claim 4, characterized in that said permanent magnet (8) is replaced by a plurality of magnets (60), which are inserted in between said inner core (3) and said outer core (1) in such a manner that said plurality of magnets rest with an inner face, which is simultaneously one magnetic pole of one of the magnets (60), on the circumference of the inner core (3), and that with an outer face (63), which is simultaneously the other magnetic pole of one of the magnets (60), on the inside of the outer core (1).

17. An electromagnet as defined by claim 5, characterized in that said permanent magnet (8) is replaced by a plurality of magnets (60), which are inserted in between said inner core (3) and said outer core (1) in such a manner that said plurality of magnets rest with an inner face, which is simultaneously one magnetic pole of one of the magnets (60), on the circumference of the inner core (3), and that with an outer face (63), which is simultaneously the other magnetic pole of one of the magnets (60), on the inside of the outer core (1).

* * * * *